US006024297A

United States Patent [19]

Greeves

[11] Patent Number: 6,024,297

[45] Date of Patent: Feb. 15, 2000

[54] FUEL INJECTOR

[75] Inventor: Godfrey Greeves, Hatch End, United Kingdom

[73] Assignee: Lucas Industries, Solihull, United Kingdom

[21] Appl. No.: 09/075,642

[22] Filed: May 11, 1998

[30] Foreign Application Priority Data

May 14, 1997 [GB] United Kingdom ..... 9709678

[51] Int. Cl.[7] ..... F02M 41/16

[52] U.S. Cl. ..... 239/96; 239/533.9; 239/533.8

[58] Field of Search ..... 239/88, 90, 91, 239/96, 533.2, 533.3, 533.9, 533.12

[56] References Cited

U.S. PATENT DOCUMENTS

| | | | |
|---|---|---|---|
| 3,982,694 | 9/1976 | Bailey | 239/96 |
| 4,151,958 | 5/1979 | Hofman | 239/533.3 |
| 4,407,457 | 10/1983 | Seifert | 239/533.12 |
| 5,551,634 | 9/1996 | Raab et al. | 239/96 |

FOREIGN PATENT DOCUMENTS

| | | | |
|---|---|---|---|
| 2710-138 | 9/1978 | Germany | 239/533.9 |
| 2711-390 | 9/1978 | Germany | 239/533.9 |
| 2726-296 | 12/1978 | Germany | 239/533.9 |
| 3113-475 | 10/1982 | Germany | 239/533.9 |
| 61-135979 | 6/1986 | Japan | 239/533.9 |

*Primary Examiner*—Lesley D. Morris
*Attorney, Agent, or Firm*—Price, Heneveld, Cooper, DeWitt & Litton

[57] ABSTRACT

A fuel injector is described which comprises an outer valve needle biased into engagement with a seating to control the supply of fuel to one or more outlet apertures, an inner valve member slidable within a bore formed in the outer valve needle and engageable with a seating to control the fuel supply to one or more further outlet apertures, the inner valve member and outer valve needle together defining a control chamber. A control valve controls the operation of the inner valve member by controlling the fuel pressure within the control chamber.

8 Claims, 6 Drawing Sheets

FUEL INJECTOR

This invention relates to a fuel injector for use in delivering fuel to a cylinder of an associated engine. In particular, the invention relates to a fuel injector of the type including a plurality of outlet apertures, the injector being operable such that, in use, fuel can be delivered either through all of the apertures, or through some but not all of the apertures.

It is an object of the invention to provide a fuel injector of the type described hereinbefore of relatively simple and convenient form.

According to the present invention there is provided a fuel injector comprising an outer valve needle slidable within a bore formed in a nozzle body and engageable with a seating to control communication between a supply passage and a delivery chamber, the delivery chamber being in constant communication with at least one outlet aperture, an inner fuel pressure actuated valve comprising an inner valve member slidable within a bore provided in the outer valve needle and engageable with a seating to control communication between the delivery chamber and at least one further outlet aperture, the inner valve member defining with the outer valve needle a control chamber, and control valve means arranged to control the fuel pressure within the control chamber to control operation of the inner fuel pressure actuated valve.

The control valve means may take the form of a fuel pressure actuated valve arranged to open when the fuel pressure applied thereto exceeds a predetermined pressure, the opening of the control valve means permitting fuel to flow from the control chamber to a low pressure drain, thus reducing the fuel pressure within the control chamber.

Alternatively, the control valve means may take the form of an electromagnetically actuable valve arranged to control communication between the control chamber and a low pressure drain. The electromagnetically actuable valve may also control communication between the supply passage and the control chamber.

The fuel injector may, for example, be of the type intended for use with a rotary distributor pump, or it may include an integral fuel pump. Alternatively it may be intended for use with a common rail type fuel system.

The invention will further be described, by way of example, with reference to the accompanying drawings, in which.

Figure 1:
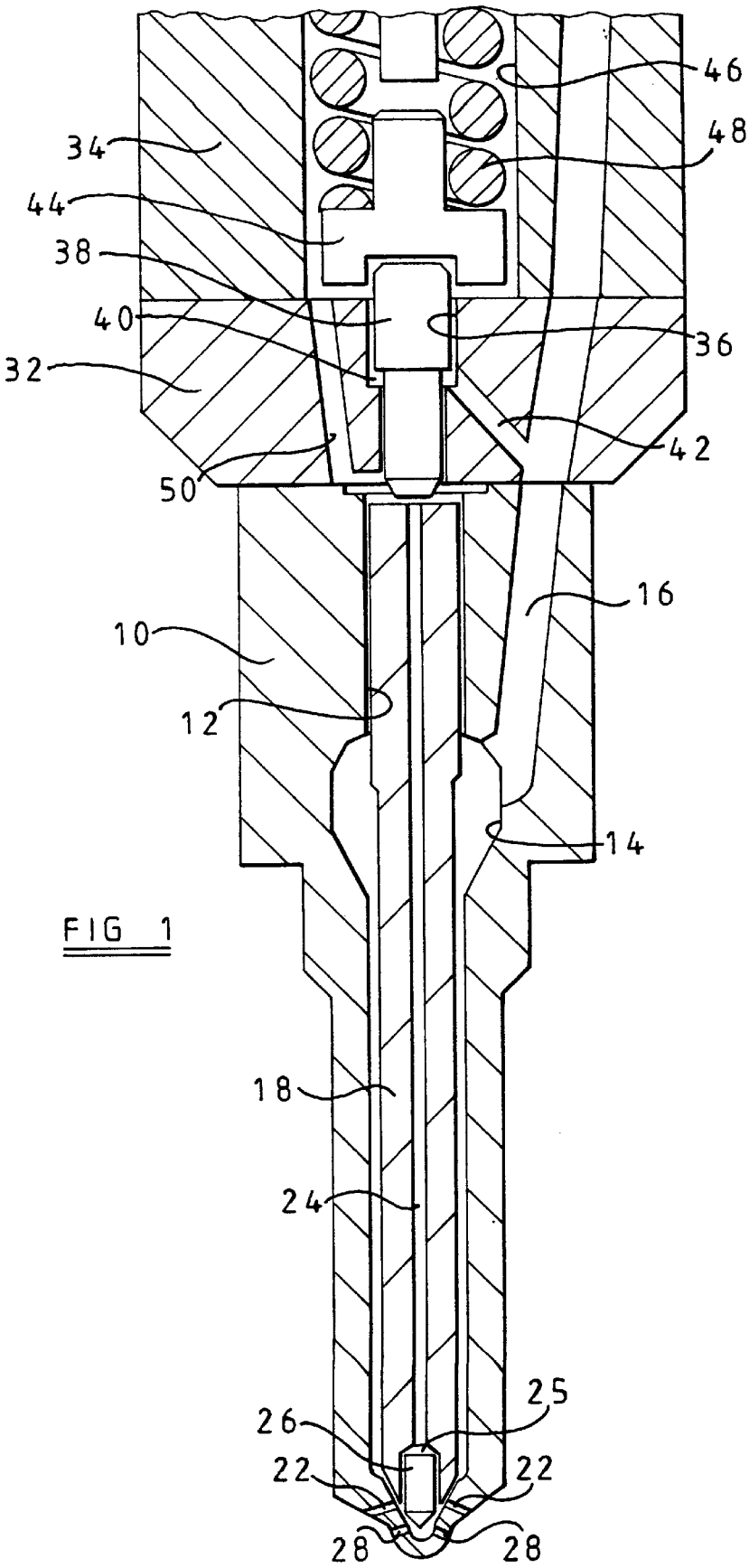
FIG. 1 is a sectional view of part of a fuel injector in accordance with an embodiment of the invention.
Figure 2:
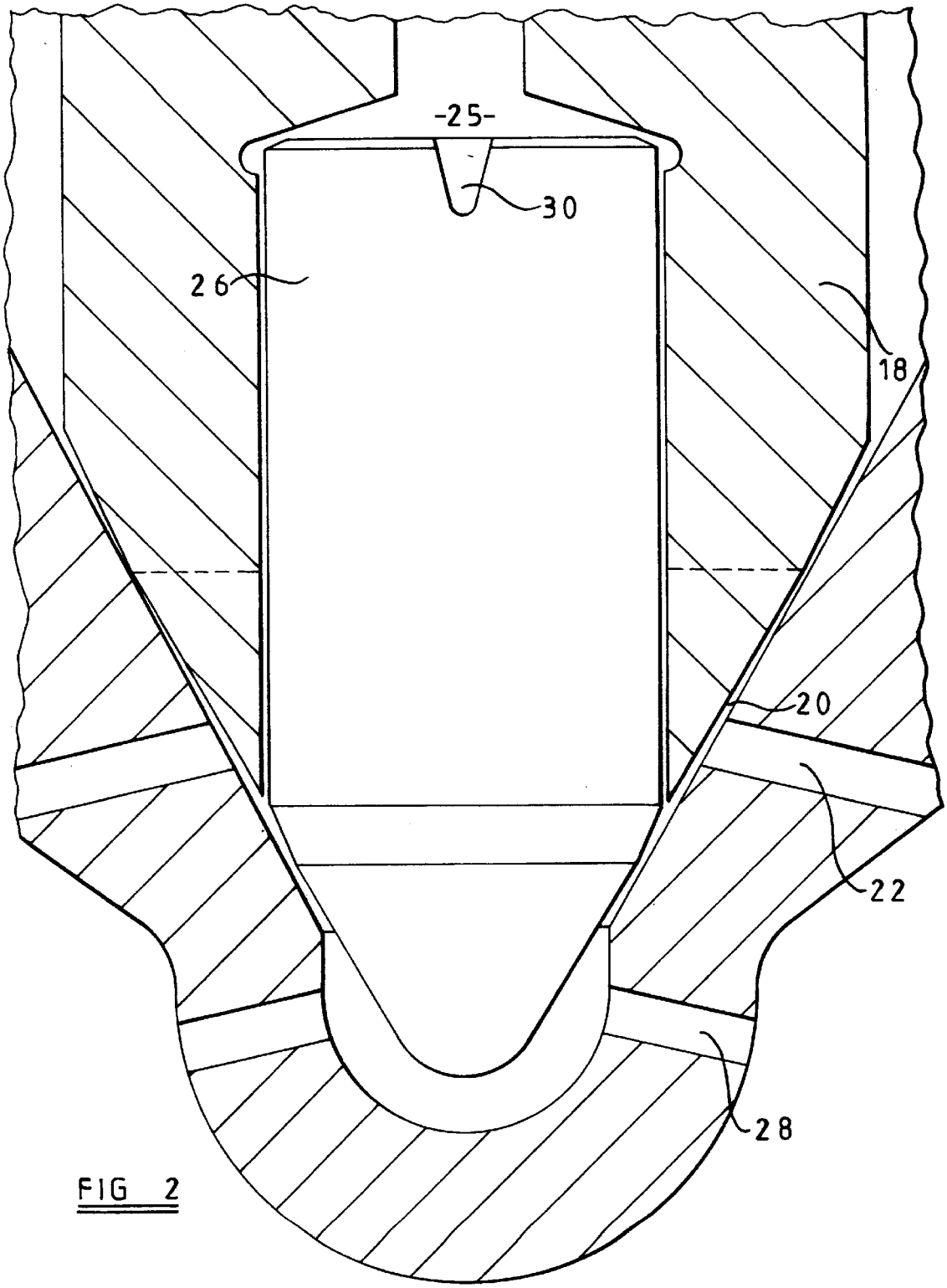
FIG. 2 is an enlargement of part of FIG. 1.

FIGS. 1 and 2 illustrate an injector which is intended for use in supplying Diesel under high pressure to a cylinder of a compression ignition internal combustion engine. The injector comprises a nozzle body 10 within which a blind bore 12 is formed. The blind bore 12 includes a region of enlarged diameter which defines a gallery 14 which communicates with a supply passage 16. The supply passage 16 is intended, in use, to communicate with a source of fuel.

An outer valve needle 18 is located within the bore 12. The needle 18 is of stepped diameter, a region of the needle 18 remote from the blind end of the bore being of diameter substantially equal to that of the bore 12 to permit the needle 18 to slide within the bore 12, whilst maintaining a substantially fluid tight seal with the nozzle body 10. A region of the needle 18 downstream of the gallery 14 is of reduced diameter permitting fuel to flow from the gallery towards the blind end of the bore 12. The needle 18 is engageable with a seating defined adjacent the blind end of the bore 12 to control communication between the supply passage 16 and a delivery chamber 20 downstream of the seating. The delivery chamber 20 is in constant communication with a plurality of outlet apertures 22 (referred to hereinafter as the first group of outlet apertures).

The needle 18 is provided with a through bore 24 which, at the end of the valve needle 18 adjacent the blind end of the bore 12, is of enlarged diameter, a valve member 26 being slidable within the enlarged diameter part of the bore 24. The valve member 26 is engageable with a seating defined adjacent the blind end of the bore 12 to control communication between the delivery chamber 20 and a plurality of outlet apertures 28 (referred to hereinafter as the second group of outlet apertures). The valve member 26 and enlarged diameter part of the bore 24 together define a control chamber 25 which communicates with the bore 24. The valve member 26 is of generally cylindrical form, but is provided with a plurality of flats whereby fuel is able to flow from the delivery chamber 20 to the control chamber 25. In order to ensure that such communication is not broken when the valve member 26 is lifted from its seating, the upper surface of the valve member 26 is provided with one or more diametrically extending grooves 30.

As shown in FIG. 1, the end of the nozzle body 10 remote from the outlet apertures engages a surface of a distance piece 32. The distance piece 32, in turn, engages a surface of a spring housing 34. In use, the nozzle body 10, distance piece 32 and spring housing 34 are secured by a cap nut (not shown) or other suitable means to a nozzle holder. The distance piece 32 and spring housing 34 each include drillings which communicate with the supply passage 16 to supply fuel to the nozzle body 10. The distance piece 32 includes a though bore 36 within which a control valve member 38 is slidable. The control valve member 38 and bore 36 are of stepped form and define therebetween a chamber 40 which communicates through a passage 42 with the supply passage 16.

The end of the control valve member 38 remote from the outer valve needle 18 engages a spring abutment 44 located within a spring chamber 46 formed within the spring housing 34. A spring 48 engages the spring abutment 44 and biases the control valve member 38 into engagement with the outer valve needle 18, closing the end of the through bore 24 and biasing the outer valve needle 18 into engagement with its seating.

In use, at rest the spring 48 biases the control valve member 38 into engagement with the end of the outer valve needle 18, biasing the outer valve needle 18 into engagement with its seating. Prior to injection, combustion gases which may enter the injector through the outlet apertures are only permitted to enter the delivery chamber 20, control chamber 25 and bore 24, movement of combustion gases beyond these parts of the injector being prevented by the engagement of the needle 18 with its seating and the engagement of the control valve member 38 with the end of the needle 18. From this position, when injection is to commence, fuel under high pressure is supplied to the supply passage 16. The application of high pressure fuel to the supply passage results in a force being applied to the outer valve needle 18 acting against the spring 48 to lift the valve needle 18 from its seating, such movement of the outer valve needle being restricted by the engagement of the outer valve needle 18 with the distance piece 32. Such movement permits fuel to flow from the supply line 16 to the delivery chamber 20 and through the first group of outlet apertures to the associated cylinder of the engine. Fuel from the delivery chamber 20 is also able to flow past the valve member 26 to the control chamber 25. As the bore 24 is closed by the control valve member 38, such flow of fuel to the control chamber 25 applies a force to the valve member 26 sufficient to move the valve member 26 into engagement with its seating thus preventing fuel delivery through the second group of outlet apertures.

If the fuel pressure within the supply passage 16 rises above a second, higher pressure, the fuel pressure within the chamber 40 is sufficient to move the control valve member 38 away from the end of the outer valve needle 18 against the action of the spring 48. Such movement opens the end of the through bore 24 permitting fuel from the control chamber 25 to flow through the through bore 24 to a low pressure drain (not shown) via a drilling 50 provided in the distance piece 32 and via the spring chamber 46. The reduction in fuel pressure within the control chamber 25 allows the valve member 26 to lift from its seating thus permitting fuel delivery through both the first and second groups of outlet apertures.

To terminate injection, the supply of high pressure fuel to the supply passage 16 is broken and the pressure therein is allowed to fall. Once the pressure has fallen below a predetermined level, the control valve member 38 moves into engagement with the outer valve needle 18 under the action of the spring 48, and subsequently the outer valve needle 18 moves into engagement with its seating, such movement preventing further fuel supply to the delivery chamber 20 thus terminating fuel injection.

The dimensions of the control valve member 38 are selected so that the control valve opens when the fuel pressure within the supply line 16 reaches a predetermined level. For example, the control valve may be arranged to remain closed at the fuel pressures achieved when the engine is operating at low speeds and loads, but to open when the engine speed is increased. By changing the number of outlet apertures through which fuel is delivered depending upon the engine operating conditions, emissions and engine noise can be reduced. Also the fuel spray penetration can be matched to the engine operating conditions.

Figure 3:
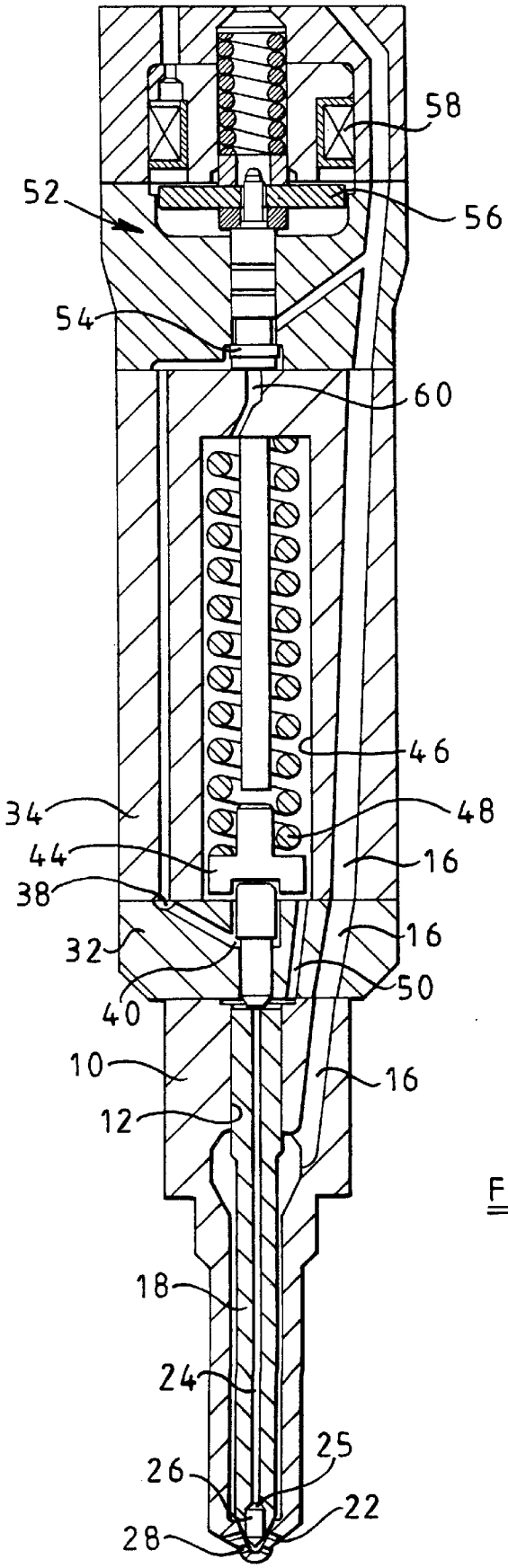
FIGS. 3 to 6 are sectional views of alternative embodiments.

The arrangement of FIG. 3 is similar to that of FIGS. 1 and 2 except that the chamber 40 is not connected directly to the supply passage 16, and instead an electromagnetically actuated valve 52 is used to control the pressure within the chamber 40. The valve 52 is a three way valve which comprises a valve member 54 slidable within a bore. The valve member 54 includes a region of enlarged diameter which is engageable with a seating to control communication between the supply passage 16 and the chamber 40, the valve member 54 being spring biased away from its seating to permit such communication. The valve member 54 carries an armature 56 which moves under the influence of the magnetic field generated by a coil 58 such that when the coil is not energised, the valve member is spaced from its seating thus the chamber 40 communicates with the supply passage 16. Energization of the coil results in such communication being broken, and instead in the chamber 40 communicating via a passage 60 with the spring chamber 46.

In use, when injection is required only through the first group of outlet apertures, the coil is energised thus the fuel pressure within the chamber 40 is low, and is insufficient to lift the control valve member 38 away from the outer valve needle 18 during fuel injection. In order to allow injection through all outlet apertures, the coil is de-energised thus during injection the fuel pressure within the chamber 40 is allowed to rise to a level resulting in movement of the control valve member 38 as described hereinbefore, whereon the valve member 26 is allowed to lift from its seating. Fuel injection is terminated by terminating the supply of fuel at high pressure to the supply line 16 as described hereinbefore.

Figure 4:
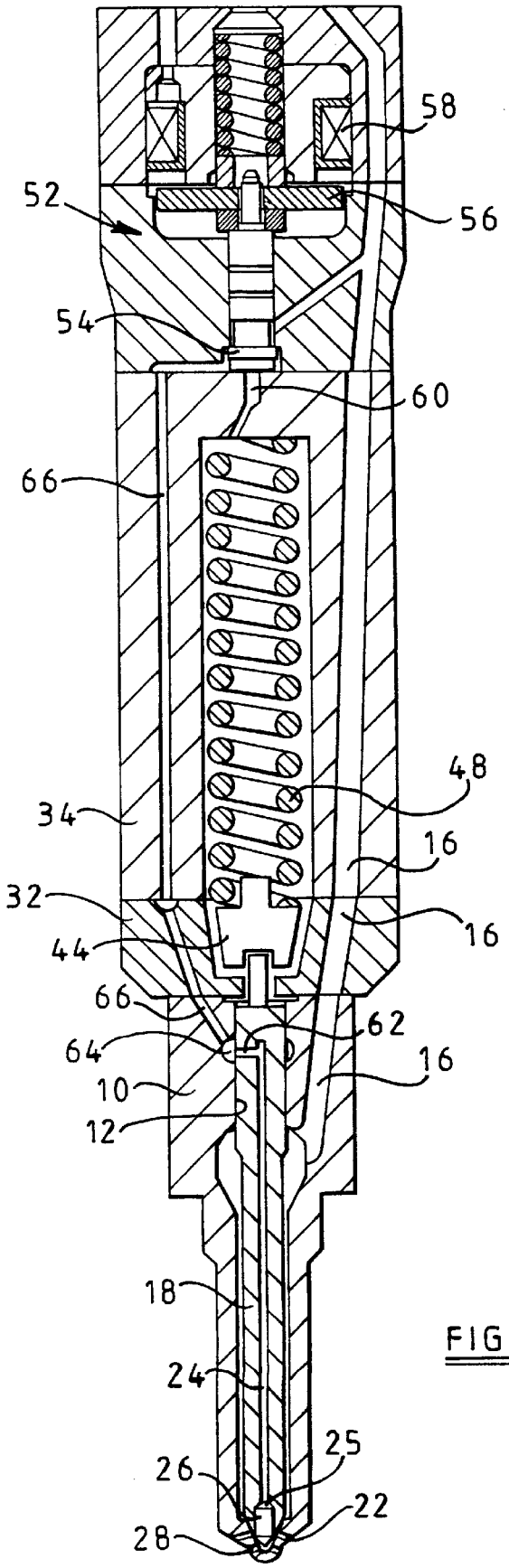

FIG. 4 illustrates an arrangement which is similar to that of FIG. 3 but in which the control valve member 38 is omitted, and instead the electromagnetically actuated valve 52 acts as the control valve. As the control valve member 38 is omitted, the spring abutment 44 acts upon an extension of the outer valve needle 18. As illustrated in FIG. 4, the bore 24 of the outer valve needle 18 is blind, and a radially extending drilling 62 is provided whereby the bore 24 communicates with an annular chamber 64. The chamber 64 communicates through a passage 66 with the control valve 52. As described with reference to FIG. 3, when the control valve 52 is not energised, the valve member 54 thereof is spaced from its seating, thus fuel at high pressure is able to flow, during fuel injection, from the supply passage 16 through the passage 66 to the bore 24 and control chamber 25, resulting in the valve member 26 engaging its seating. Injection therefore only takes place via the first group of outlet apertures. When injection is required through both groups of outlet apertures, the control valve 52 is energised, terminating the supply of high pressure fuel to the control chamber 25, and instead connecting the control chamber 25 to the spring chamber 46. As described hereinbefore, the valve member 26 can then lift from its seating to permit injection through the second group of outlet apertures.

As described hereinbefore, when injection is to be terminated, the fuel pressure within the supply passage 16 is allowed to fall, resulting in the needle moving into engagement with its seating under the action of the spring 48.

As fuel can be supplied directly to the control chamber 25, flats are no longer required on the valve member 26, and the grooves 30 can be omitted. Further, the valve member 26 is designed so that when it occupies its fully lifted position, the engagement of the valve member 26 with the bore 24 prevents combustion gases from entering the part of the bore 24 of reduced diameter.

Figure 5:
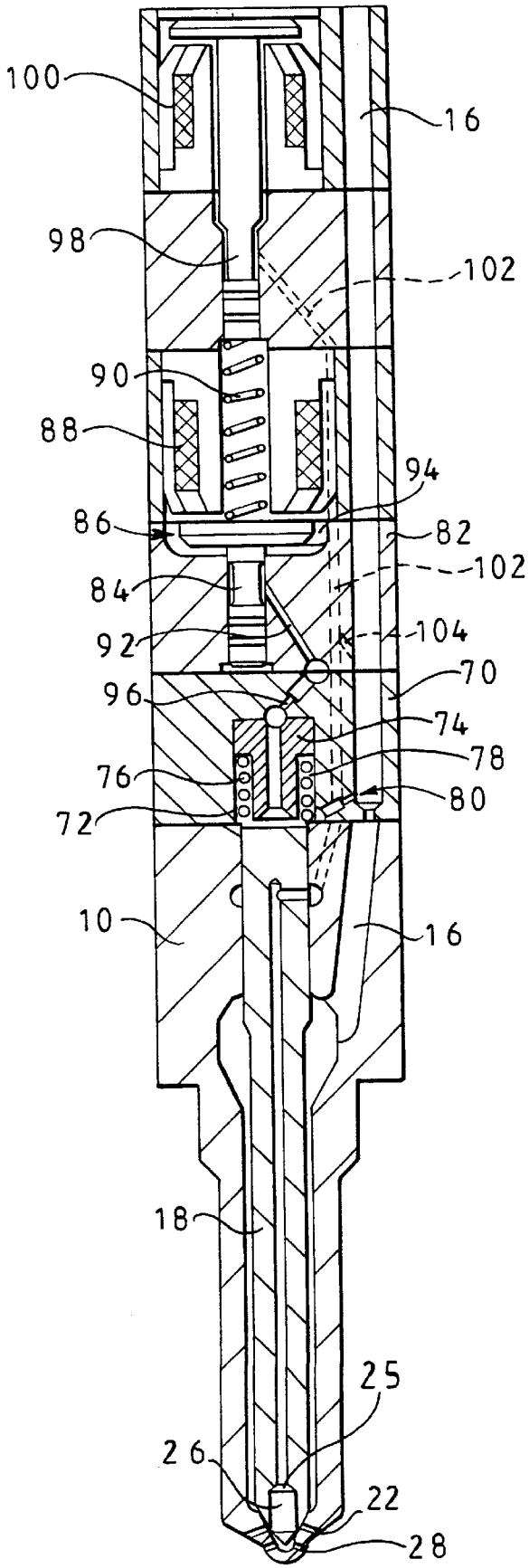
Figure 6:
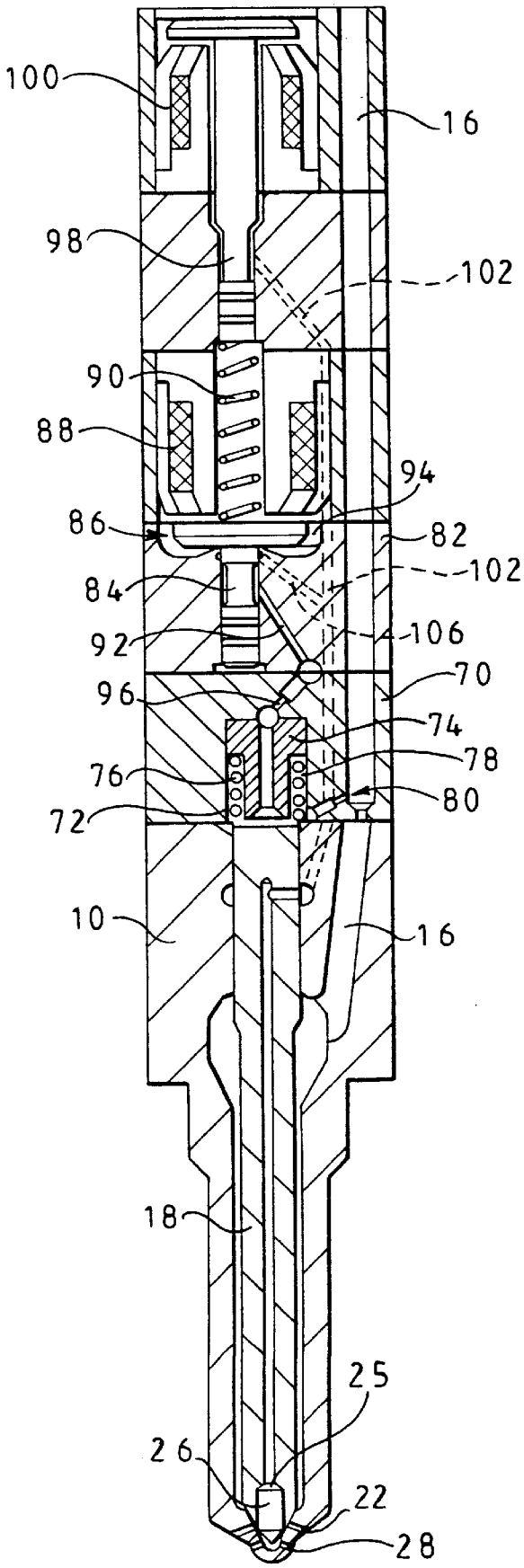

The fuel injectors described hereinbefore are of the type in which the timing of fuel delivery is controlled by appropriately controlling the timing at which fuel under high pressure is supplied to the injector, for example by using an appropriately controlled rotary fuel pump. It will be appreciated, however, that the invention is also applicable to injectors intended for use in other types of fuel system. For example, the invention is applicable to fuel injectors intended for use in a common rail fuel system. FIGS. 5 and 6 illustrate injectors in accordance with embodiments of the invention suitable for use with a common rail fuel system.

The injector illustrated in FIG. 5 comprises a nozzle body 10 which is similar to that illustrated and described with reference to FIG. 4. An outer valve needle 18 is slidable within a bore formed in the nozzle body 10, an inner valve member 26 being slidable in an enlarged portion of a bore formed in the outer valve needle 18 as described hereinbefore. As this part of the injector is substantially identical to that described with reference to FIG. 4, further description of this part of the injector and its manner of operation is not included.

The upper end of the nozzle body 10 abuts a spring housing 70 which includes a blind bore 72 defining, with the upper part of the nozzle body 10 and upper end surface of the outer valve needle 18, a control chamber 78 within which a needle stop member 74 is located, a helical compression spring 76 being engaged between the stop member 74 and the upper end surface of the outer valve needle 18.

The control chamber 78 communicates through a restricted passage 80 with the supply line 16, the supply line 16 communicating, in use, with a source of fuel under high pressure, for example a common rail charged with fuel to an appropriately high pressure by a suitable fuel pump.

The upper end surface of the spring housing 70 abuts a valve housing 82 which includes a through bore within which a control valve member 84 is slidable, the upper end of the control valve member 84 carrying an armature 86 which is moveable under the influence of a magnetic field generated, in use by an actuator 88. A spring 90 is arranged to urge the control valve member 84 towards a position in which it engages a seating to prevent fuel from flowing from a drilling 92 to a chamber 94 which communicates with a low pressure drain. The drilling 92 communicates through a restricted passage 96 with the control chamber 78.

The spring 90 further engages a second control valve member 98 which is moveable under the influence of a second actuator 100 to control communication between a passage 102 defined by drillings extending through various parts of the injector to control the fuel pressure within the control chamber 25 defined between the outer valve needle 18 and the inner valve member 26 which controls whether or not the inner valve member 26 is urged into engagement with its seating. The passage 102 communicates with the supply passage 16 through a restricted passage 104, thus when the second control valve member 98 engages its seating, the fuel pressure applied to the upper end of the inner valve member 26 is relatively high.

In use, fuel under pressure is applied to the supply passage 16, thus the fuel pressure acting upon various angled thrust surfaces of the outer valve needle 18 urging the valve needle 18 away from its seating is relatively high. Provided the actuator 88 is not energized, a similarly high pressure is present in the control chamber 78 thus a force is applied to the outer valve needle 18 supplementing the force applied by the spring 76 urging the outer valve needle 18 towards its seating. The magnitude of the force urging the outer valve needle 18 towards its seating is greater than that urging it away from its seating, thus the outer valve needle 18 engages its seating and fuel is not able to flow to either of the groups of outlet apertures 22, 28.

In order to commence injection, the actuator 88 is energized to lift the first control valve member 84 from its seating thus permitting a reduction in the fuel pressure present in the control chamber 78, hence reducing the downward force applied to the outer valve needle 18. As a result, the force urging the outer valve needle 18 towards its seating is reduced, and a point will be reached beyond which the outer valve needle 18 is able to lift from its seating. The movement of the outer valve needle 18 away from its seating is limited by engagement of the upper end surface thereof with the stop member 74. The movement of the outer valve needle 18 from its seating permits fuel to flow to the delivery chamber downstream of the seating of the outer valve needle 18, thus permitting fuel delivery through the first group of outlet apertures 22.

If the second actuator 100 is not energized, then the second control valve member 98 is urged away from its seating by the spring 90 thus the fuel pressure applied to the upper end surface of the inner valve member 26 is low. As a result, the inner valve member 26 is urged away from its seating, and injection occurs through both the first group of outlet apertures 22 and the second group of outlet apertures 28. However, if the second actuator 100 is energized, fuel is unable to escape from the passage 102 to the low pressure drain, and as fuel is supplied to the passage 102 from the supply passage 16 through the restricted passage 104, the fuel pressure applied to the upper end of the inner valve member 26 is high, and the inner valve member 26 is urged into engagement with its seating, thus preventing fuel delivery through the second group of outlet apertures 28. It will be recognised that the mode of operation of the injector, including whether to deliver fuel through only the first group of apertures or both groups of apertures, depends upon the intended use of the injector and upon prevailing operating conditions.

In order to terminate injection, the first actuator 88 is deenergised, and the first control valve member 84 returned into engagement with its seating by the spring 90. As a result, the fuel pressure within the control chamber 78 rises, and a point will be reached beyond which the outer valve needle 18 returns into engagement with its seating, thus terminating injection. As illustrated in FIG. 5, a flow restriction is provided in the supply passage 16, thus during injection the fuel pressure applied to the outer valve needle 18 falls, with the result that rapid termination of injection can be achieved.

It will be appreciated that in the arrangement illustrated in FIG. 5, where injection is to occur through both groups of outlet apertures 22, 28, the flow of fuel to the passage 102 through the restricted passage 104, and the subsequent flow of fuel from the passage 102 to the low pressure drain results in a quantity of fuel being wasted, and thus in the injector operating relatively inefficiently. FIG. 6 illustrates a modification in which this inefficiency is reduced. In the arrangement of FIG. 6, the restricted passage 104 is omitted, and instead the passage 102 communicates through a passage 106 with a location just downstream of the seating with which the first control valve member 84 is engageable. In such an arrangement, where injection is not taking place, fuel under pressure is not applied to the passage 102, thus the inner valve member 26 may occupy a position in which it does not engage its seating. However, as injection is not occurring at this stage due to the engagement of the outer valve needle 18 with its seating, such location of the inner valve member 26 is acceptable. During injection, the first control valve member 84 is lifted from its seating, and fuel flows from the control chamber 78 past the seating, a quantity of this fuel flowing through the passage 106 to the passage 102. If the second control valve member 98 is spaced from its seating, then such a flow of fuel to the passage 102 simply results in fuel being displaced from the passage 102 past the seating with which the second control valve member 98 is engageable to a low pressure drain without significantly effecting the fuel pressure applied to the inner valve member 26, thus the inner valve member 26 can occupy a position in which it is spaced from its seating, thus permitting injection of fuel through the second group of outlet apertures 28. However, if the second actuator 100 is energized and the second control valve member 98 engages its seating, then the flow of fuel through the passage 106 to the passage 102 results in a relatively high pressure being applied to the upper end of the inner valve member 26, thus ensuring that the inner valve member 26 is urged into engagement with its seating thus permitting fuel delivery through only the first group of outlet apertures, and not the second group of outlet apertures 28.

It will be appreciated that in the arrangement of FIG. 6, as the passage 102 is not supplied with fuel directly from the supply passage 16, but instead is supplied with fuel which would otherwise be flowing to the low pressure drain from the control chamber 78, the injector of FIG. 6 operates more efficiently than that of FIG. 5 in that the quantity of high pressure fuel which escapes to the low pressure drain is reduced.

I claim:

1. A fuel injector comprising an outer valve needle slidable within a bore formed in a nozzle body and engageable with a seating to control communication between a supply passage and a delivery chamber, the delivery chamber being in constant communication with at least one outlet aperture, an inner fuel pressure actuated valve comprising an inner valve member slidable within a bore provided in the outer valve needle and engageable with a seating to control communication between the delivery chamber and at least one further outlet aperture, the inner valve member defining with the outer valve needle a control chamber, and control valve means arranged to control the fuel pressure within the control chamber to control operation of the inner fuel pressure actuated valve.

2. An injector as claimed in claim 1, wherein the control valve means comprises a fuel pressure actuated valve arranged to open when the fuel pressure applied thereto exceeds a predetermined pressure, the opening of the control valve means permitting fuel to flow from the control chamber to a low pressure drain, thus reducing the fuel pressure within the control chamber.

3. An injector as claimed in claim 2, wherein the fuel pressure applied to the control valve means is controlled by an electromagnetically actuable valve.

4. An injector as claimed in claim 3, further comprising a flow path defined between the outer valve needle and the inner valve member whereby fuel under pressure is supplied to the control chamber, in use.

5. An injector as claimed in claim 1, wherein the control valve means comprises an electromagnetically actuable valve arranged to control communication between the control chamber and a low pressure drain.

6. An injector as claimed in claim 5, wherein the electromagnetically actuable valve further controls communication between the supply passage and the control chamber, the electromagnetically actuable valve comprising a three-way valve.

7. An injector as claimed in claim 6, wherein the electromagnetically actuable valve comprises a valve member including an end surface engageable with a planar surface to close a flow path, the valve member further including a region engageable with a frusto-conical seating to close another flow path, the valve member being moveable under the control of an electromagnetic actuator.

8. An injector as claimed in claim 1, further comprising a control valve controlling movement of the outer valve needle to control the timing of fuel injection substantially independently of the fuel pressure within the supply passage.

* * * * *